United States Patent [19]

Konishi et al.

[11] 4,098,247

[45] Jul. 4, 1978

[54] MINUTE PRESSURE CONTROL SYSTEM

[75] Inventors: Kiyokazu Konishi, Kariya; Hiroshi Yoshida, Aichi, both of Japan

[73] Assignee: Nippondenso Co., Ltd., Kariya, Japan

[21] Appl. No.: 721,843

[22] Filed: Sep. 9, 1976

[30] Foreign Application Priority Data

Sep. 22, 1975 [JP] Japan ..... 50-115308

[51] Int. Cl.[2] ..... F02M 5/00

[52] U.S. Cl. ..... 123/119 R; 261/72 R; 261/DIG. 67; 137/624.15; 137/624.2

[58] Field of Search ..... 137/624.13, 624.15, 137/624.18, 624.2, 14; 123/119 R, 119 EC; 261/72 R, DIG. 67

[56] References Cited

U.S. PATENT DOCUMENTS 3,921,612 11/1975 Aono ..... 123/119 R

FOREIGN PATENT DOCUMENTS 1,228,444 4/1971 United Kingdom ..... 137/14 UX 1,303,540 1/1973 United Kingdom ..... 137/14 UX

*Primary Examiner*—Alan Cohan

*Attorney, Agent, or Firm*—Cushman, Darby & Cushman

[57] ABSTRACT

A minute pressure control system which combines constant positive pressure and constant negative pressure together to control pressure in a controllable object is disclosed. An electronic control circuit generates a train of pulses modulated in accordance with a preset value. The two constant pressures, either one thereof being switched on and off in response to the pulses, are applied to a surge tank to be combined together therein. The surge tank absorbs pressure pulsation resulting from on-off switching application of the pressure and controls the pressure in the controllable object such as a half-closed chamber to the value preset by the electronic control circuit.

7 Claims, 4 Drawing Figures

MINUTE PRESSURE CONTROL SYSTEM

BACKGROUND OF THE INVENTION

1. Field of the Invention

The present invention is related to a minute pressure control system, wherein either constant positive pressure or constant negative pressure is switched on and off prior to being combined together.

2. Description of the Prior Art

A pressure control system for controlling the pressure of an object, ranging from a negative pressure to a positive pressure, is known in the art. It is a well-known art in this system that either a constant positive pressure or a constnt negative pressure is alternately applied to the controllable object in response to the deviation between a preset pressure and an actual pressure. Therefore, a specific feedback loop therefor is needed, causing the system to be complicated.

SUMMARY OF THE INVENTION

It is, therefore, a primary object of this invention to control the pressure of an object without feedback loop.

It is another object of this invention to switch on and off either a constant positive pressure or a constant negative pressure in accordance with a preset value.

It is a further object of this invention to control on-off switching of a constant pressure in response to a train of pulses.

It is a still further object of this invention to absorb pressure pulsation resulting from on-off switching of the constant pressure.

DETAILED DESCRIPTION OF THE PREFERRED EMBODIMENT

Figure 1:
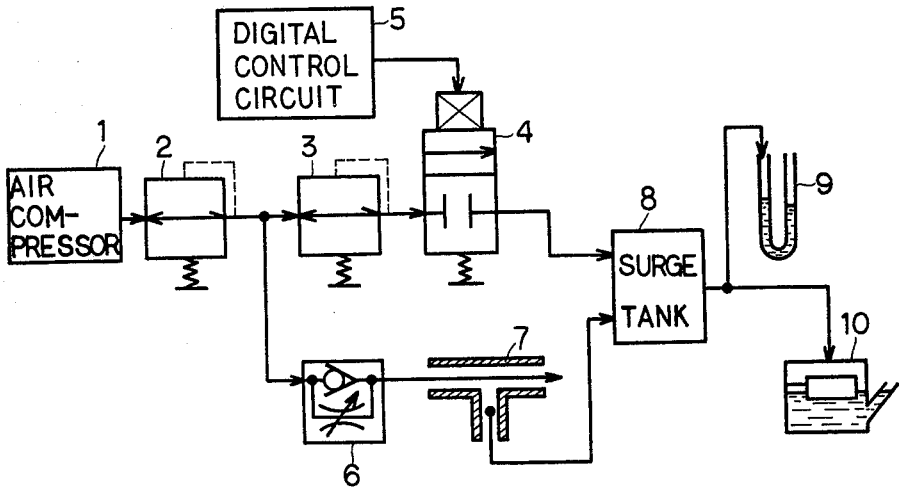
FIG. 1 is a block diagram illustrating one emobidment of the present invention.

The present invention is described hereinunder with reference to an embodiment shown in the drawing.

Referring first to FIG. 1, numeral 1 designates an air compressor for generating the pressurized air of a constant positive pressure, 2 and 3 air regulators coupled in series for stabilizing the pressurized air by lowering the pressure to an arbitrary constant pressure and 4 an air nozzle constituting switching means for switching on and off air flow of the positive pressure in response to on-off ratio variation.

Connected to the air nozzle 4 is a digital control circuit 5 constituting control means for generating a train of pulses which determines on-off repetition period of the air nozzle 4 to be constant and arbitrarily determines the on-off ratio of the air nozzle 4 depending upon a given preset value.

In parallel to a positive pressure path, an air choke valve 6 for presetting air flow amount to an arbitrary value and a negative pressure generator 7 are coupled. The generator 7 utilizes the phenomenon that when air flows through the straight portion of a T-shaped pipe, a constant minute negative pressure develops at the bypassing portion thereof.

Numeral 8 designates a surge tank, connected to the air nozzle 4 and negative pressure generator 7, for absorbing pulsation of the air provided through the air nozzle, preventing the short-circuit between the positive pressure and the negative pressure and absorbing minute pressure fluctuation of a controllable object 10. A U-shaped pipe 9 is coupled to the surge tank 8 and filled half way with water for reading the pressure of the controllable object 10 and opened to the atmosphere at one end thereof.

The controllable object 10, in this embodiment, is a carburetor float chamber of a gasoline engine, wherein air-to-fuel ratio between air amount and gasoline amount is varied by controlling the float chamber pressure.

Figure 2:
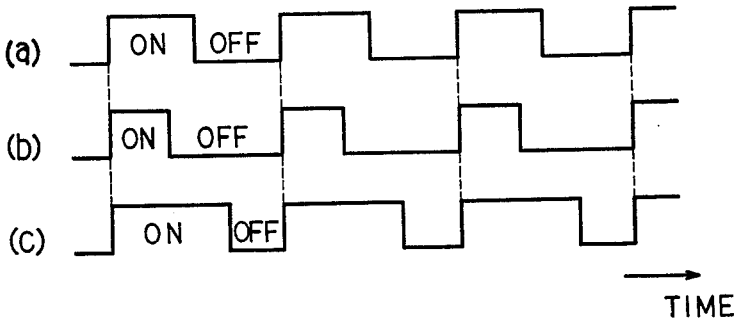
FIG. 2 is a time chart showing on-off ratio variations (a) to (c) of the air nozzle used in this embodiment.

FIG. 2 is a time chart showing on-off ratio variations (a) to (c) of the air nozzle 4 at three kinds of conditions.

Figure 3:
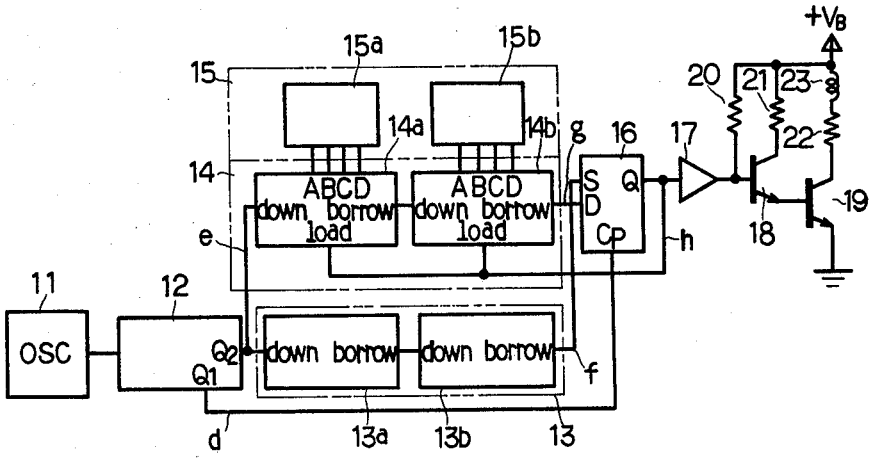
FIG. 3 is an electric wiring diagram illustrating a digital control circuit used in the embodiment.

Referring next to FIG. 3 showing the digital control circuit 5, numeral 11 designates an oscillator for generating a train of pulses of a fixed frequency, 12 a binary counter for dividing the frequency of the pulses from the oscillator 11 to the one suitable for the system.

Connected to the "$Q_2$" terminal of the binary counter 12 are an 8-bit binary counter 13 which is comprized of two-series-connected 4-bit binary counters 13*a* and 13*b* and generates a pulse at the "borrow" terminal after counting 256 clock pulses, an 8-bit preset counter 14 which is comprised of two series-connected 4-bit preset binary counters 14*a* and 14*b*. The preset counter 14 discriminates the count value in such a manner that it reads in the preset data from the "ABCD" terminal upon receipt of "0" level signal at the "load" terminal, counts down the preset data in response to each clock pulse applied to the "down" terminal upon receipt of "1" level signal at the "load" terminal and generates a discrimination pulse at the "borrow" terminal when the preset data becomes zero.

Numeral 15 designates an 8-bit presetter comprised of two 4-bit switching elements 15*a* and 15*b* for providing the "ABCD" terminal of the preset counter 14 with the preset data. Numeral 16 designates an RSD flip-flop which memorizes "0" level pulse generated at the "borrow" terminal of the binary counter 13 and feeds the "borrow" terminal signal of the preset counter 14 to the "Q" terminal in the timed relationship with the rising edge of the clock pulse which is earlier by one cycle period than that of the binary counter 13 and the preset counter 14.

Connected to the RSD flip-flop 16 is an amplifier which is comprised of a buffer amplifier 17 for current-amplifying the output Q signal of the RSD flip-flop 16, a transistor 18 for current amplifying, a power transistor 19 for driving a load 23, resistors 20 and 21 for respectively supplying the transistors 18 and 19 with base currents and a series resistor 22 for speeding up the operation of the load 23. The load 23 is an electromagnetic coil of the air nozzle 4 shown in the overall construction of FIG. 1.

Figure 4:
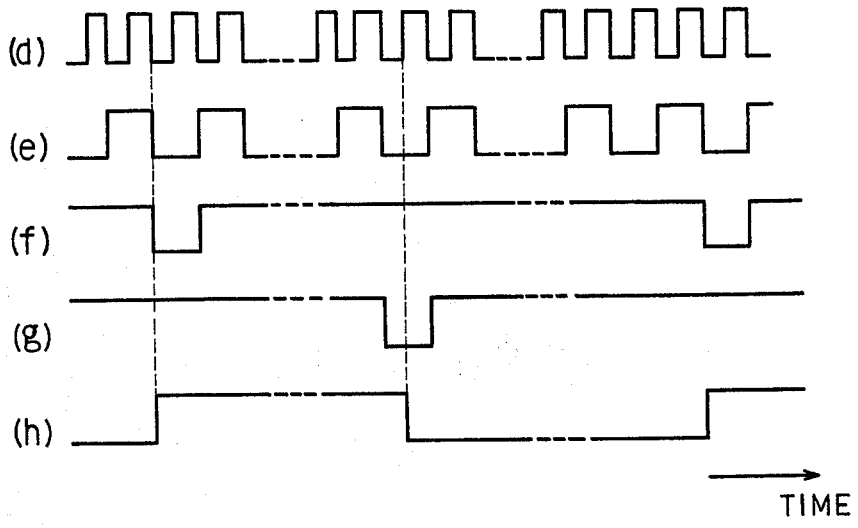
FIG. 4 is a time chart showing signal waveforms (d) to (h) appearing at respective points (d) to (h) in FIG. 3.

FIG. 4 is a time chart showing waveforms at various points of the digital control circuit 5 of FIG. 3, wherein (d) shows clock pulses at the output $Q_1$ of the binary counter 12 or a point *d*, (e) clock pulses at the output $Q_2$ of a point *e* which is reversed in synchronism with the falling edge of the output $Q_1$, (f) output signals at the "borrow" terminal of the binary counter 13 or a point *f*, (g) discrimination signals at the "borrow" terminal of the preset counter 14 or a point *g* and (h) signals at the output Q of the RSD flip-flop 16 or a point *h*.

Operation according to the above construction is described next. The pressurized air generated by the air compressor 1 is regulated to the constant pressure by the air regulator 2 and parallelly applied to the air regulator 3 and the air choke valve 6. Keeping the amount of air flowing into the negative pressure generator 7 to be constant by the choke valve 6 causes the generator 7 to generate at the bypassing portion thereof the minute constant negative pressure, which is supplied in turn to the one pressure inlet of the surge tank 8. The air kept at the constant positive pressure by the air regulator 3 is supplied to the other pressure inlet of the surge tank 8 through the air nozzle 4 which controls the air flow amount in accordance with the on-off ratio thereof commanded by the digital control circuit 5.

It is assumed herein that the pressure range required by the controllable object 10 is ± 50 mm water column. For this assumption, the digital control circuit 5 is first switched off to fully close the air nozzle 4 and the choke valve 6 is so adjusted that water column difference of the U-shaped pipe 9 becomes 50 mm in the negative pressure side. The digital control circuit 5 is then switched on to set the on-off ratio of the air nozzle 4 to be 50% as shown in the time chart (a) of FIG. 2 and the air regulator 3 is so adjusted that the water column difference of the U-shaped pipe 9 becomes approximately zero.

Under this adjustment, the digital control circuit 5 with one preset valve adjusted toward the negative pressure side so controls the on-off ratio of the air nozzle 4 as to shorten the switching-on time interval as shown in (b) of FIG. 2. Air supply amount from the air regulator 3 to the surge tank 8, as a result, becomes less than that of the case of the on-off ratio 50% to accomplish the required pressure in the negative pressure side.

In case of the other preset value adjusted toward the positive pressure side, the switching-on time interval of the air nozzle 4 is lengthened as shown in (c) of FIG. 2 to accomplish the required pressure in the positive pressure side.

Operation of the digital control circuit 5 is explained with reference to the wiring diagram shown in FIG. 3 and the time chart shown in FIG. 4. The binary counter 13 generates "0" level pulse at the "borrow" terminal at the time when it finishes counting 256 clock pulses applied to the "down" terminal. This signal waveform at the point *f* is shown in (f) of FIG. 4. The "borrow" output of the binary counter 13 is applied to the RSD flip-flop 16, the output Q of which is set to "1" level. This signal waveform at the point *h* is shown in (h) of FIG. 4.

The preset counter 14, on the other hand, starts downcounting at the time when signal level at the "load" terminal becomes "1" and generates "0" level pulse at the "borrow" terminal when the data becomes zero. This signal waveform at the point *g* is shown in (g) of FIG. 4. The "borrow" output of the preset counter 14 is applied to the "D" terminal of the RSD flip-flop 16 and then fed to the output Q to render the signal level to "0" in synchronization with the rising edge of the clock pulse (d) of FIG. 4 which is earlier by one cycle period than the clock pulse (e) of FIG. 4 applied to the binary counter 13 and the preset counter 14.

After one cycle time during which the binary counter 13 counts 256 pulses, the binary counter 13 generates "0" level pulse again at the "borrow" terminal and the output Q of the RSD flip-flop 16 is set to "1". With the repetition of this operation, the on-off ratio of the air nozzle 4 under the constant repetition period is determined depending upon the command value of the presetter 15. The output of the RSD flip-flop drives, by the transistors 18 and 19, the electromagnetic coil 23 of the air nozzle 4 via the buffer amplifier 17.

The digital control circuit 5 thus produces the train of pulses, the one-off ratio thereof being modulated in proportion to the preset value, and the air nozzle 4 switches on and off the transmission of the positive pressure in response thereof, the pressure in the controllable object 10 therefore is maintained to the preset pressure value.

Although the above described pressure control ranging fully ± 50 mm water column cannot be attained because of the dead zone of the air nozzle 4, it can be attained by primarily setting the preset value a little wider.

In the experiment according to this construction, minute pressure control ranging from under ± 10 mm water column to ± 200 mm water column is proved to be possible with the precision higher than 5% with respect to the preset value.

According to the above-described embodiment, a system is provided in which the constant negative pressure generated at the bypassing portion by passing the constant amount of air through the straight portion of the T-shaped pipe is supplied with some amount of air metered by the on-off ratio of the air nozzle 4 controlled by the digital control circuit 5 and the surge tank 8 is provided to absorb pressure pulsation of the air nozzle 4, to prevent negative pressure inlet and positive pressure inlet from short-circuiting by positioning apart to each other and to prevent pulsation of the controllable object. Thus the system is constructed so simply without the specific feedback loop that it becomes compact, light weight and inexpensive.

Further the pressure resolving power does not change even if pressure control range is set narrower because it depends only upon the on-off ratio resolving power of the air nozzle 4 and the pressure resolving power is arbitrarily made higher if the digital control circuit 5 is provided with more control bits.

Owing to the advantage that the minute pressure is controlled precisely ranging from the negative pressure to the positive pressure, this system can be applied, for instance, to the pressure control of the carburetor float chamber of the gasoline engine for controlling engine air-to-fuel ratio with precision and ease. Upon this application, detection signal derived from analysis of engine exhaust emission components may be fed back to the digital control circuit 5.

Although one system is described in the above embodiment in which the surge tank 8 is constantly supplied with the minute negative pressure generated by the T-shaped pipe negative pressure generator 7 and intermittently supplied with the positively-pressurized air through the air nozzle 4, the other system may be provided in which the negative pressure is switched on and off instead.

And although the digital control circuit 5 is used as a control means for switchng on and off the air nozzle 4, analogue control circuit capable of pulse width modulation corresponding to the preset value for varying on-off ratio under the constant frequency may be used.

Further other fluid may be used instead in the air.

What we claim is:

1. A minute pressure control system comprising:

a compressor for producing a positive pressure fluid;

a pressure regulator, coupled to said compressor, for regulating the pressure of said positive pressure fluid;

a T-shaped pipe having a straight portion and a branched bypass portion, said straight portion being coupled to said pressure regulator to thereby generate a negative pressure fluid in said bypass portion;

an electronic control circuit for generating a control signal having a predetermined on-off ratio;

a switching valve, coupled to said pressure regulator and said electronic control circuit, for intermittently passing said regulated positive pressure fluid in response to said control signal; and a surge tank having two inlets and an outlet, said inlets being respectively communicated with said bypass portion and said switching valve to thereby combine said regulated positive pressure fluid and said negative pressure fluid and generate a control pressure at said outlet thereof.

2. A minute pressure control system comprising:

first mens for producing a constant positive pressure;

second means for producing a constant negative pressure, said second means including a T-shaped pipe having a straight portion communicated to receive said constant positive pressure and a bypass portion vertically branched from said straight portion to produce said constant negative pressure;

third means, connected to said first and second means, for combining said positive and negative pressure applied thereto;

control means for generating a pulse signal, on-off ratio thereof being dependent upon a predetermined pattern; and switching means, electrically connected to said control means, for switching on and off the application of at least one of said positive and negative pressures, whereby said third means produces a control pressure variable with said on-off ratio of said pulse signal.

3. A minute pressure control system as claimed in claim 2 further comprising:

a carburetor having a float chamber to which said control pressure is applied from said third means.

4. A minute pressure control system as claimed in claim 2, wherein said first means comprises:

an air compressor for producing a positively pressurized air;

a first regulator, coupled to said air compressor, for regulating the pressure of said air applied from said air compressor; and a second regulator, coupled between said first regulator and said switching means, for further regulating the pressure of said air applied from said first regulator.

5. A minute pressure control system as claimed in claim 4, wherein said second mens further includes:

a choke valve, coupled to said first regulator, for passing a constant amount of air applied from said first regulator to said T-shaped pipe.

6. A minute pressure control system as claimed in claim 5, wherein said switching means comprises:

an electromagnetically-operated air nozzle, connected between said second air regulator and said third means, for intermittently applying said regulated positive pressure to said third means in response to said pulse signal.

7. A minute pressure control system as claimed in claim 6, wherein said third means comprises:

a surge tank having two inlets and an outlet, one inlet thereof receiving said constant positive pressure intermittently applied from said air nozzle and the other inlet thereof receiving said constant negative pressure constantly applied from said T-shaped pipe.

* * * * *